US009917400B2

(12) United States Patent
Chatelus

(10) Patent No.: US 9,917,400 B2
(45) Date of Patent: Mar. 13, 2018

(54) ELECTRICAL CONNECTOR HOUSING

(71) Applicant: Tyco Electronics France SAS, Pontoise (FR)

(72) Inventor: Eric Chatelus, Bourg la Reine (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 14/322,721

(22) Filed: Jul. 2, 2014

(65) Prior Publication Data

US 2015/0017826 A1 Jan. 15, 2015

(30) Foreign Application Priority Data

Jul. 9, 2013 (FR) ..... 13 56752

(51) Int. Cl.

*H01R 13/627* (2006.01)
*H01R 13/506* (2006.01)
*H01R 13/514* (2006.01)
*H01R 13/52* (2006.01)

(52) U.S. Cl.

CPC ..... *H01R 13/6272* (2013.01); *H01R 13/506* (2013.01); *H01R 13/514* (2013.01); *H01R 13/52* (2013.01); *H01R 13/5202* (2013.01)

(58) Field of Classification Search

CPC .. H01R 13/506; H01R 13/62; H01R 13/6278; H01R 13/6273; H01R 13/6272; H01R 13/6271; H01R 13/4364

USPC ..... 439/607.05, 101, 108, 686, 695, 701, 439/712, 724, 140, 141, 752

See application file for complete search history.

(56) References Cited

U.S. PATENT DOCUMENTS 5,071,369 A * 12/1991 Denlinger et al. ..... 439/595
5,292,261 A * 3/1994 Hirano et al. ..... 439/752
5,607,327 A * 3/1997 Tsuji et al. ..... 439/752
5,769,664 A * 6/1998 Saito et al. ..... 439/595

(Continued)

FOREIGN PATENT DOCUMENTS

CN 1498446 5/2004
CN 101803120 8/2010
EP 0 791 984 A2 8/1997

OTHER PUBLICATIONS

Extended European Search Report and comments issued by the European Patent Office, Munich, Germany, dated Jul. 29, 2014, for European Patent Application No. 14175781.5; 8 pages.

(Continued)

*Primary Examiner* — Edwin A. Leon
*Assistant Examiner* — Paul Baillargeon
(74) *Attorney, Agent, or Firm* — Faegre Baker Daniels LLP

(57) ABSTRACT

The invention relates to a front housing of an electrical connector, particularly for sealed applications, said front housing being designed to be connected to a base and being configured to be at least partially received in a main housing of said electrical connector, said front housing comprising: at least one locking means configured to engage a corresponding locking zone of said main housing so as to lock said front housing to said main housing, and said front housing further comprising a plurality of contact sockets designed to each receive an electrical conductor to connect to said base. The invention further relates to a main electrical connector housing, to an electrical connector, to a base and to an electrical connector assembly.

11 Claims, 8 Drawing Sheets

(56) References Cited

U.S. PATENT DOCUMENTS

| | | | | |
|---|---|---|---|---|
| 5,931,700 | A * | 8/1999 | Saito et al. | 439/595 |
| 6,383,020 | B2 * | 5/2002 | Taguchi et al. | 439/587 |
| 7,476,133 | B2 * | 1/2009 | Tanaka et al. | 439/752 |
| 8,075,351 | B2 * | 12/2011 | Park et al. | 439/752 |
| 8,469,752 | B2 * | 6/2013 | Park | 439/752 |

OTHER PUBLICATIONS

English translation of First Office Action, issued by the State Intellectual Property Office of the People's Republic of China, dated Sep. 1, 2017, for related Chinese patent application No. 2014104092182; 11 pages.

First Office Action, issued by the State Intellectual Property China, dated Sep. 1, 2017, for related Chinese Office of the People's Republic of patent application No. 2014104092182; 8 pages.

* cited by examiner

ELECTRICAL CONNECTOR HOUSING

The present application claims priority from French national application FR1356752, filed Jul. 9, 2013 the subject matter of which is incorporated herein by reference.

BACKGROUND

The present invention relates to an electrical connector, particularly to an electrical connector comprising a front housing and a main housing, with the front housing being configured to be received in a base. The invention particularly relates to the problem of the retention between the front housing and the main housing of the connector when disconnecting the connector and the base. The invention further relates to a main housing of an electrical connector, to a base and to an electrical connector assembly.

As is known in the prior art, electrical connector housings that are designed to electrically connect one or more conductors to a counterpart base generally comprise a plurality of parts manufactured using plastics technology techniques. It is known, particularly in the case of electrical connectors with a large number of channels, that the various parts that form the assembly of the connector housing require complex moulds, using removable or movable mould slides that can cross, as well as several moulding directions, thus making the moulding of these parts even more complex.

Therefore, there is a continuous requirement in plastics technology for simplifying the manufacture of the various parts that form the electrical connector housings, particularly for connectors comprising a large number of channels.

Such electrical connectors that are known in the prior art generally comprise a main housing and a front housing configured to be received and fixed in the main housing, with the front housing being the part of the connector comprising the terminals and which is therefore configured to be received in the base. Furthermore, the electrical connectors that are known in the prior art can further comprise a rear housing and a cover, with the cover comprising the locking system allowing the connector assembly to be locked to the base, and the rear housing allowing the one or more electrical conductors to be guided from the cover toward the main housing.

In addition to the constraints that exist for moulding these various elements, there is also a problem associated with the retention between the main housing and the front housing when disconnecting the connector from its base. In effect, if the retention force between the main housing and the front housing is not sufficient, it is possible for the front housing to remain housed in the base instead of remaining rigidly connected to the front housing during disconnection. The problem of retention is even greater if the connector and its base have a large number of channels.

Therefore, in the prior art the use of hook systems is known, which systems allow the front housing to be retained with the main housing, including when disconnecting the connector from its base. In particular, it is known in the prior art for these retention hooks to be arranged on the periphery of the front housing and to hook onto suitable openings on the periphery of the main housing in order to lock these two elements together.

However, in the case of electrical connectors for sealed applications, particularly in the automotive industry, such a system proves to be a disadvantage due to the presence of one or more seals arranged on one or more peripheries of the main housing, which seals are generally referred to as "interface" or "peripheral" seals. In effect, the moulding element of the support surface of the peripheral seal can then be crossed by the elements that mould the attachment zones of the front housing or the support surface of the peripheral seal even can be moulded by two or more elements that can generate seam lines at their junction. The traces, namely burrs, thus generated on the support surface of the peripheral seal present leakage risks. Therefore, there is a risk of degradation to the seal of such connector housings that are known in the prior art.

Thus, in addition to the moulding constraints associated with the aforementioned plastics technology techniques, there is a requirement, particularly in the automotive industry, for providing electrical connector housing elements with a plurality of channels that can be used for sealed applications, particularly in restricted spaces, so as to maintain the seal of the connector.

SUMMARY

An object of the present invention therefore is to provide an electrical connector housing taking into account the aforementioned problems and requirements that are found both in plastics technology and in the automotive industry.

According to one aspect of the present invention, the object is achieved by a front housing of an electrical connector, particularly an electrical connector for sealed applications, said front housing being designed to be connected to a base and being configured to be at least partially received in a main housing of said electrical connector, said front housing comprising: at least one locking means configured to engage a corresponding locking zone of said main housing so as to lock the front housing to the main housing, and said front housing further comprising a plurality of contact sockets designed to each receive an electrical conductor to be connected to said base. According to this aspect of the invention, said at least one locking means can be arranged between contact sockets of said plurality of contact sockets.

The arrangement of the locking means of a front housing according to this aspect of the present invention allows a good support surface to be provided for the peripheral seal arranged on a periphery of the main housing of the electrical connector, which is advantageous compared to the known connectors of the prior art, particularly in the sealed applications that are found in the automotive industry.

The invention allows the use of one or more locking or retention means, the quantity and the size of which can be adapted according to the retention force that is required between the front housing and the main housing. In this way, when disconnecting a connector, comprising a front housing according to this aspect of the present invention, from its counterpart base, the greater the number of channels, i.e. conductors or electrical terminals, there are in the connector to be connected to the base, the greater the necessity for retaining the front housing in the main housing. The higher the number of channels to be connected, the greater the number of locking means that can be included in the front housing according to this aspect of the invention, with the size of said locking means also being able to be adapted in order to enhance the retention with the main housing compared to the known connectors of the prior art. Therefore, the invention advantageously allows detachment to be prevented between the front housing and the main housing compared to the known housings of the prior art, whilst preserving the support surface of the peripheral seal and thus the impermeability of the system.

Furthermore, according to non-limiting variants of this aspect of the present invention:

a. preferably, said locking means can project relative to a zone of the front housing comprising said plurality of contact sockets. In this way, the locking means can be advantageously arranged substantially following the direction of assembly of the front housing to the main housing, which can be substantially perpendicular to the zone in which the contact sockets are arranged so as to allow proper retention between the front housing and the main housing;

b. preferably, the contact sockets of the plurality of contact sockets can be arranged in rows of contact sockets, in which case it is advantageous for said at least one locking means to be arranged between rows of contact sockets. This arrangement is advantageous compared to the known front housings of the prior art as it allows the simplified integration of the retention means in the moulds used in plastics technology, the design of which is already complex, particularly when the front housing comprises a large number of contact sockets. The invention therefore does not further complicate the design of the moulds for casting the front housings.

Advantageously, said at least one locking means can be arranged in at least one trough separating rows of contact sockets. This is advantageous compared to the known housings of the prior art in the case of front housings comprising troughs for receiving walls for protecting electric contacts of the base, to which the electrical connector has to be connected.

Advantageously, at least one locking means can be a hook comprising a head provided with a locking catch, and further comprising a stem extending said head.

Also advantageously, at least one locking means can be a harpoon comprising a head provided with two locking catches, and further comprising two stems extending said head substantially in an inverted U-shape.

The combination of these geometries and of the arrangement of the locking means according to this aspect of the present invention has the advantage of simplifying the design of the moulds compared to the moulds of front housings that are known in the prior art. In effect, the locking means of front housings according to this aspect of the present invention can be wholly obtained by basically using the two main moulding directions, without using an additional mould slide and without crossing between mould slides or additional movement in the mould during moulding.

Advantageously, the stems can extend inside of said at least one trough. It is therefore possible for the locking means, for example hooks or U-shaped harpoons, to be integrated within the walls for protecting the contacts of the base that are accommodated in at least one trough of the front housing. Such a design allows a head of the locking means to be obtained that is at least partially flexible, and which can be deflected when the front housing is assembled with the main housing, so as to clip into the corresponding locking zone of the main housing. The stems of the locking means extending in the troughs then enable the structure of the locking means to be strengthened.

According to a further aspect of the present invention, the object is achieved by a main housing of an electrical connector, particularly an electrical connector for sealed applications, said main housing being configured to at least partially receive a front housing of an electrical connector, said main housing comprising: at least one locking zone configured to receive a corresponding locking means of a front housing according to the preceding aspect of the present invention or according to any one of its variants.

A main housing of an electrical connector according to this further aspect of the present invention advantageously improves the retention with a front housing according to the preceding aspect compared to main housings that are known in the prior art, particularly when disconnecting the assembled electrical connector and a base.

In the case of a main housing for a connector designed for sealed applications, the arrangement of the locking zones according to this aspect of the present invention advantageously provides the proper support surface for the peripheral seal. This aspect of the invention is therefore advantageous compared to the main housings of electrical connectors for sealed applications that are known in the prior art.

Furthermore, this aspect of the invention can be easily implemented in plastics technology given that the design of the mould for a main housing that is known in the prior art only needs to be slightly modified to allow the integration of the locking zones according to this aspect of the present invention.

Furthermore, according to non-limiting variants of this aspect of the present invention:

Preferably, the main housing of an electrical connector can further comprise a plurality of conductor guide sockets each corresponding to a respective contact socket of said front housing, in which case it is advantageous for said at least one locking zone to be arranged between guide sockets of said plurality of guide sockets. This variant is advantageous compared to the main housings that are known in the prior art, particularly in combination with a variant of the front housing according to the preceding aspect of the present invention comprising a plurality of corresponding contact sockets.

Preferably, said at least one locking zone can comprise at least one stop for effecting a lock with a corresponding locking catch of said at least one locking means of a front housing according to advantageous variants of the preceding aspect of the present invention. This variant is advantageous compared to the main housings that are known in the prior art, particularly in combination with a variant of the front housing according to the preceding aspect of the present invention, the locking means of which is of the hook or U-shaped harpoon type.

Preferably, the guide sockets of said plurality of guide sockets can be arranged in rows of guide sockets, particularly corresponding to the rows of contact sockets of a front housing according to preferred variants of the preceding aspect of the present invention. It is then advantageous for said at least one locking zone to be arranged between rows of guide sockets. This variant is advantageous relative to the main housings that are known in the prior art, particularly in combination with a variant of the front housing according to the preceding aspect of the present invention, in which the plurality of contact sockets is arranged in rows corresponding to the rows of guide sockets of this variant of a main housing.

Advantageously, said at least one locking zone can form a trough partially separating rows of guide sockets. This variant is advantageous compared to the main housings that are known in the prior art, particularly in combination with a variant of the front housing according to the preceding aspect of the present invention that comprises troughs separating rows of contact sockets.

In preferred embodiments of this aspect of the present invention, said main housing can also be configured to partially receive a rear housing designed to guide at least one electrical conductor in the main housing. This variant is advantageous for a large number of electrical conductors so as to guide them toward the corresponding guide sockets of the main housing.

In advantageous embodiments of this aspect of the present invention, at least part of said plurality of guide sockets can be surrounded by a rear seal reception zone. This variant is advantageous and allows at least one zone of the main housing to be configured to receive a rear seal or "grommet" seal or any other type of peripheral seal in order to seal the connector for a sealed application.

In advantageous embodiments of this aspect of the present invention, at least one guide socket among said plurality of guide sockets can be a seal channel designed to receive a conductor provided with a single-wire seal. This variant is also advantageous for rows of sockets designed to receive large diameter conductors each requiring a single-wire seal to effect the seal when used for a sealed application.

In advantageous embodiments of this aspect of the present invention, at least one seal channel can be a different diameter to the diameter of another seal channel. It is therefore possible to advantageously configure the main housing according to this aspect of the present invention to receive conductors with different diameters. According to the types of conductors and corresponding wiring, it is possible to combine this variant with the use of a rear seal isolating a plurality of electric contacts between the front housing and the base from the external environment and/or with the use of conductors with a single-wire seal isolating a single corresponding contact at a time from the external environment.

According to a still further aspect of the present invention, the object is also achieved by an electrical connector designed to connect a plurality of electrical conductors to a base, said electrical connector comprising: a front housing according to one of the preceding aspects or any one of its variants, and a main housing according to one of the preceding aspects or any one of its variants, configured to partially receive a rear housing from a first side and said front housing from a second side, opposite the first side.

An electrical connector comprising a front housing and a main housing according to the preceding aspects is therefore advantageous compared to a known connector of the prior art as it combines the advantages of the preceding aspects of the invention and their variants.

Preferably, the electrical connector according to this aspect of the present invention can further comprise: a cover, configured to guide a plurality of electrical conductors in said electrical connector and to lock said electrical connector to a base, and/or a rear housing, configured to guide the plurality of electrical conductors from the cover toward the main housing, and/or at least one rear seal arranged on a periphery of the main housing.

According to a still further aspect of the present invention, the object is achieved by a base designed to be connected to an electrical connector according to one of the preceding aspects or any one of its variants, said base comprising: a plurality of electric contacts, particularly arranged in rows of electric contacts, and at least one protection wall arranged between electric contacts, particularly arranged between rows of electric contacts, configured to be received in a corresponding trough of the front housing, particularly a front housing according to advantageous variants of an aspect of the present invention, of said electrical connector. According to this aspect of the present invention, said at least one protection wall can be discontinuous over its length, particularly over the length of the rows of electric contacts, so that it has at least one slot adapted to partially receive a corresponding locking element of the front housing of said electrical connector.

The known bases of the prior art generally have protection walls between the electric contacts, which walls are designed to protect the contacts when the base is handled by a user by creating barriers preventing the fingers of a user from accidentally bending the electric contacts of the base. Compared to the known bases of the prior art, a base according to this aspect of the present invention advantageously allows the design of the walls for protecting contacts to be adapted to the inventive aspect relating to the front housing of an electrical connector designed to be connected to the base. In particular, a base according to this aspect of the invention is advantageous in combination with a variant of the front housing according to one of the preceding aspects, in which at least one locking means is arranged in troughs of the front housing, and for which stems extend into said troughs.

As is the case for the preceding aspects associated with the front housing and the main housing, this aspect of the invention has the advantage of being easily adaptable in plastics technology given that the design of the moulds of the various parts of the connector or of the base is not further complicated compared to the known prior art, and is even simplified.

Finally, according to a still further aspect of the invention, the object is also achieved by an electrical connector assembly comprising: an electrical connector according to one of the preceding aspects of the present invention or any one of its variants, a plurality of electrical conductors designed to be connected to the electric contacts of a base, and a base according to the preceding aspect of the present invention. This aspect of the invention allows the preceding aspects and their variants to be combined.

Therefore, the present invention is advantageous when a high retention force is required between two parts of an electrical connector, such as a front housing and a main housing. In particular, the invention is advantageous compared to the known electrical connector housing systems of the prior art when disconnecting an assembled connector and a counterpart base, as it prevents the front housing of the electrical connector from remaining connected to the base whilst the rest of the connector, particularly the main housing, is disconnected. When disconnecting a connector according to the present invention, the front housing and the main housing therefore remain rigidly connected to each other whereas the front housing, and more generally the connector, is disconnected from the base, which is an advantage compared to the known systems of the prior art, in which the retention force between the main housing and the front housing is not sufficient to prevent them from being disconnected during disconnection from a base. Therefore, the invention is advantageous for electrical connectors arranged in restricted spaces and/or for connectors comprising a large number of channels, i.e. a large number of electrical conductors to be connected to counterpart contacts of a base.

The invention has an advantageous application in the field of automotive connectors, particularly for applications in a sealed environment in which the main housing comprises a rear peripheral seal and/or seal guides or seal channels for conductors with a single-wire seal.

BRIEF DESCRIPTION OF THE DRAWINGS

The various aspects of the invention and their advantageous variants will be explained in further detail throughout the remainder of the document with reference to advantageous embodiments, and with reference to the following appended drawings, wherein.

DETAILED DESCRIPTION

Figure 1A:
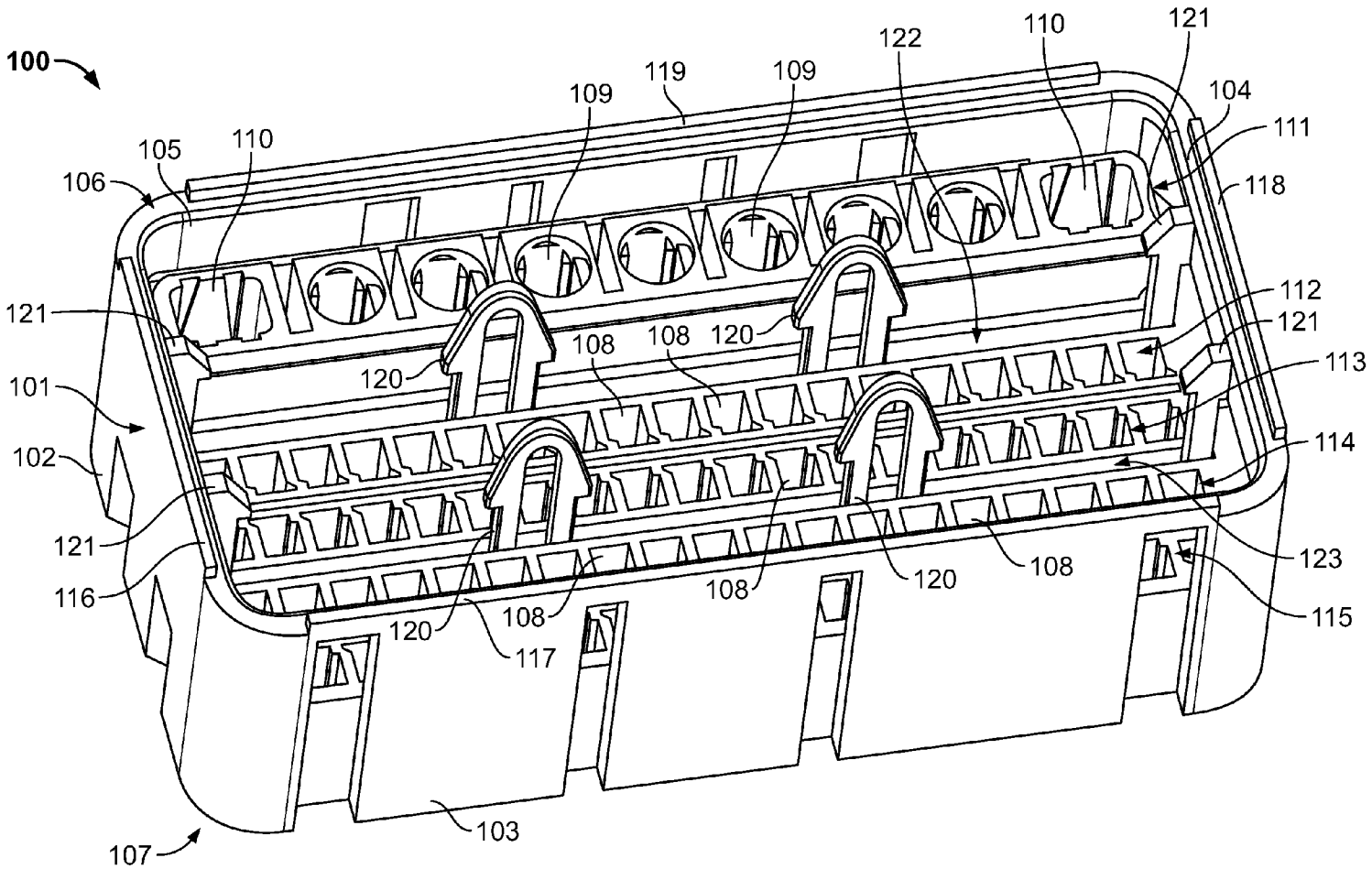
FIG. 1A schematically shows an embodiment example of a front housing of an electrical connector, according to one aspect of the present invention, in a three-dimensional view.
Figure 1B:
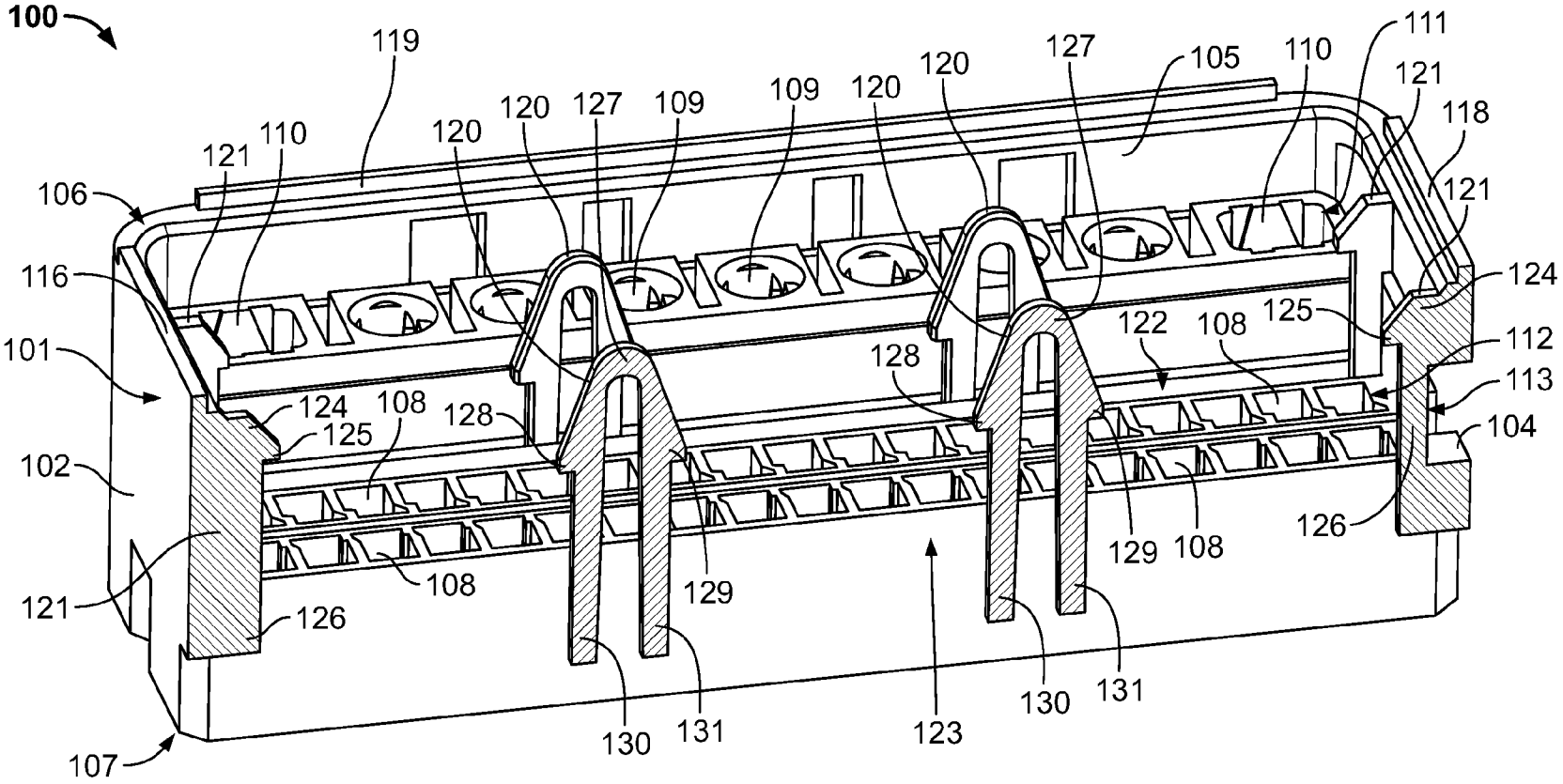
FIG. 1B is a section view of the front housing shown in FIG. 1A.

As shown in FIGS. 1A-1B, a front housing 100 of an electrical connector according to this aspect of the present invention can comprise a body 101 of substantially parallelepiped shape, with four walls 102, 103, 104, 105 and two main open faces 106, 107, inside of which a plurality of contact sockets 108, 109, 110 is arranged, which sockets are designed to receive electrical conductors, such as electric cables, provided with electric contact terminals. One of the main faces of the front housing 100, in this case the main face 106, can be configured to be received in a main housing of said electrical connector, for example, the main housing 200 of the embodiment shown in FIGS. 2A-2B, whereas the opposite main face, in this case therefore the main face 107, can be configured to be received in a counterpart base, for example, the base 500 shown in FIG. 5, in order to effect the electrical connection between the plurality of electrical conductors, not shown here for the sake of simplicity, received in the contact sockets 108, 109, 110 and the counterpart electric contacts of the base.

In order to allow electric contact between various types of contacts, according to one advantageous variant of this aspect of the present invention, the contact sockets 108, 109, 110 can be adapted to different types of contacts, particularly with different cable diameters or more generally electrical conductors to be connected to the counterpart base. The embodiment example shown in FIGS. 1A-1B represents three types of contact sockets 108, 109, 110, but a person skilled in the art will understand that in other embodiments of this aspect of the present invention a front housing could only comprise one type of contact socket or even two types of contact sockets or even three different types of contact sockets, depending on the connectivity requirements of the user, so that the geometry of the front housing 100 and the arrangement of the contact sockets 108, 109, 110 are modular. Furthermore, for the sake of understanding, it is noteworthy that only some of the plurality of sockets of the type referenced 108, 109 have been given reference numerals, even though the illustration shows more contact sockets than these two respective types. Similarly, only two sockets of the type referenced 110 have been shown, but a person skilled in the art will understand that the combination of the various types of contact sockets 108, 109, 110 is modular and will depend on the requirements of the user.

According to one advantageous variant of this aspect of the present invention, the contact sockets 108, 109, 110 of the front housing 100 are arranged in a plurality of rows of sockets 111, 112, 113, 114, 115, which advantageously allows, and consequently facilitates, the organisation of the arrangement of electric contacts designed to be connected to a counterpart base, in which the electric contacts will also be arranged in equivalent rows. In this embodiment example of a front housing 100 there are five rows of sockets 111, 112, 113, 114, 115, but this does not limit this aspect of the present invention. In effect, in other embodiments, it is possible for part or even all of the contact sockets 108, 109, 110 not to be arranged in rows or even for the number of rows or the quantity of sockets 108, 109, 110 in a row 111, 112, 113, 114, 115 to vary compared to the embodiment shown in FIGS. 1A-1B.

Thus, the plurality of contact sockets 108, which are those with a smaller diameter in the example shown in FIGS. 1A-1B, comprise the rows of contact sockets 112, 113, 114, 115, whereas the plurality of contact sockets 109, 110 comprise the row of contact sockets 111. In particular, the rows 112, 113, 114, 115 each comprise twenty contact sockets 108, whereas the row 111 comprises seven contact sockets 109, with an intermediate diameter, and two contact sockets 110, one at each end of the row 111, of larger diameter. Of course, a person skilled in the art will understand that the arrangement shown in FIGS. 1A-1B does not limit the present invention and only represents one possible variant among other variants.

FIGS. 1A-1B also show that the walls 102, 103, 104, 105 can each comprise a respective rib 116, 117, 118, 119. The ribs 116, 117, 118, 119 can be advantageous in the case of an electrical connector for sealed applications by coming into abutment against a seal of the main housing of the electrical connector, as will be described hereafter.

Furthermore, in order to ensure locking and retention between the front housing 100 and a main housing of an electrical connector, according to one aspect of the present invention, the front housing 100 shown in FIGS. 1A-1B comprises at least one locking means 120, 121 arranged between the contact sockets 108, 109, 110. In the embodiment shown in FIGS. 1A-1B, the front housing 100 comprises four locking means 120 and four locking means 121, which project from the main face 106, particularly relative to the plurality of contact sockets 108, 109, 110. A person skilled in the art will understand that the number and the dimensions of the locking means 120, 121 are modular as a function of the retention force that is required between the front housing 100 and the corresponding main housing of an electrical connector, particularly in order to keep the front housing 100 rigidly connected to the main housing when the electrical connector that is assembled and connected to a base is disconnected from said base.

FIGS. 1A-1B also show that, according to one preferred variant of an aspect of the present invention, troughs 122, 123 passing through the body 101 from one side to the other, particularly from the main face 106 to the opposite main face 107, separate certain rows of contact sockets 111, 112, 113, 114, 115. In this case, the trough 122 separates the rows 111 and 112, whereas the trough 123 separates the rows 113 and 114. In the case in which the main housing and/or the base respectively comprise a partitioning wall and/or a contacts protection wall, these walls can be at least partially received in the troughs 122, 123 of the front housing 100 during assembly of the electrical connector on the one hand and during connection to the base on the other hand. A person skilled in the art will understand therefore that the arrangement of the troughs 122, 123 is modular as a function of the design of the main housing and of the base to which the front housing 100 will be connected. Therefore, according to one variant of an aspect of the present invention, and as is particularly shown in the section view of FIG. 1B, the locking means 120, 121 are arranged in the troughs 122, 123.

According to one advantageous variant of the present invention, certain locking means 120, 121, the locking means 121 in FIGS. 1A-1B, can be hooks 121 comprising a head 124 provided with a locking catch 125, and further comprising a stem 126 extending from the head 124. In one variant, which is shown in particular in the section view of FIG. 1B, the stem 126 can extend into the troughs 122, 123 and essentially form an integral part of the body 101 of the front housing 100.

According to a further advantageous variant of the present invention, certain other locking means 120, 121, in this case the locking means 120 in FIGS. 1A-1B, can be harpoons 120 substantially in the shape of an arrow comprising a head 127 provided with two locking catches 128, 129, and further comprising two stems 130, 131 extending from the head 127. In a variant, as shown in particular in the section view of FIG. 1B, the stems 130, 131 can extend in the troughs 122, 123 and thus essentially form an integral part of the body 101 of the front housing 100. Thus, the harpoons 120 have a head 127 of substantially inverted U or V shape, and project relative to the main face 106. The stems 130, 131 then extend the head 127 providing a general aspect in the shape of an inverted U.

Therefore, the locking means 120, 121 have stems 126, 130, 131 that are rigid in the part that is integral with the body 101, i.e. the part that is physically inside the troughs 122, 123, whereas the projecting part of the stems 126, 130, 131 and the heads 124, 127 is flexible so as to engage a matching locking zone of a main housing, as will be described hereafter.

As shown in FIGS. 1A-1B, certain locking means 120, 121, in this case the harpoons 120, can be arranged in zones substantially at the centre of the plurality of contact sockets of the type referenced 108 and 109, whereas other locking means 120, 121, in this case the hooks 121, can be arranged at the edge of the troughs 122, 123 between the rows of sockets 111 and 112, as well as 113 and 114, so as to substantially form part of the walls 102, 104 of the body 101 of the front housing 100.

A further advantage of the hooks 121 and harpoons 120 of the embodiment example shown in FIGS. 1A-1B is that they can be incorporated into the moulds used in plastics technology without complicating their already complex design, particularly when the front housing 100 comprises a large number of contact sockets 108, 109, 110. Furthermore, the combination of hooks 121 and harpoons 120 and, more generally, the arrangement of the locking means 120, 121 according to this aspect of the present invention, has the advantage of simplifying the design of the moulds compared to the moulds for front housings that are known in the prior art. In effect, the means for locking front housings according to this aspect of the present invention can be wholly obtained by basically using the two main moulding directions, without using an additional mould slide and without crossing between mould slides or additional movement in the mould during moulding.

Figure 2A:
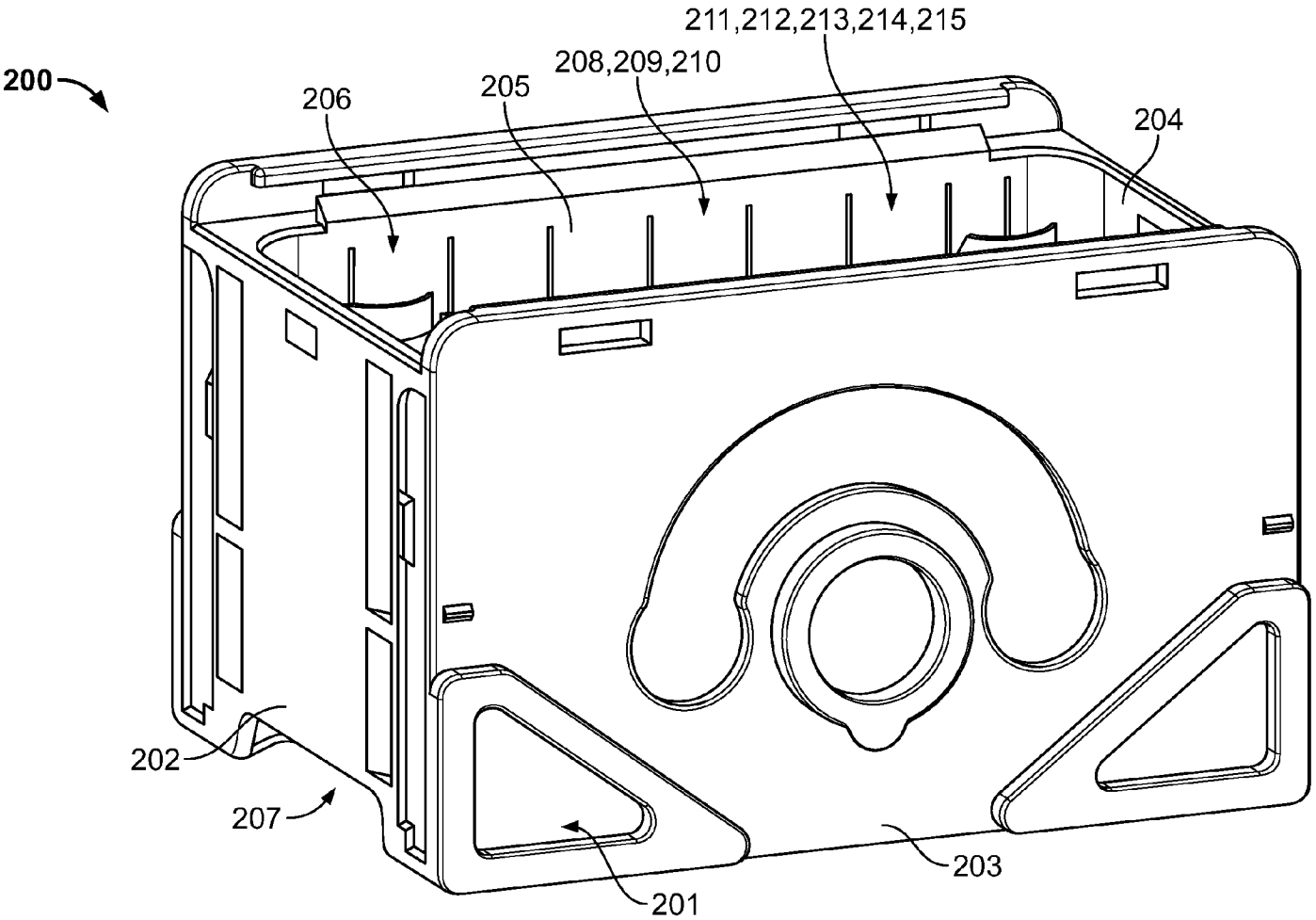
FIG. 2A schematically shows an embodiment example of a main housing of an electrical connector, according to one aspect of the present invention, in a three-dimensional view.
Figure 2B:
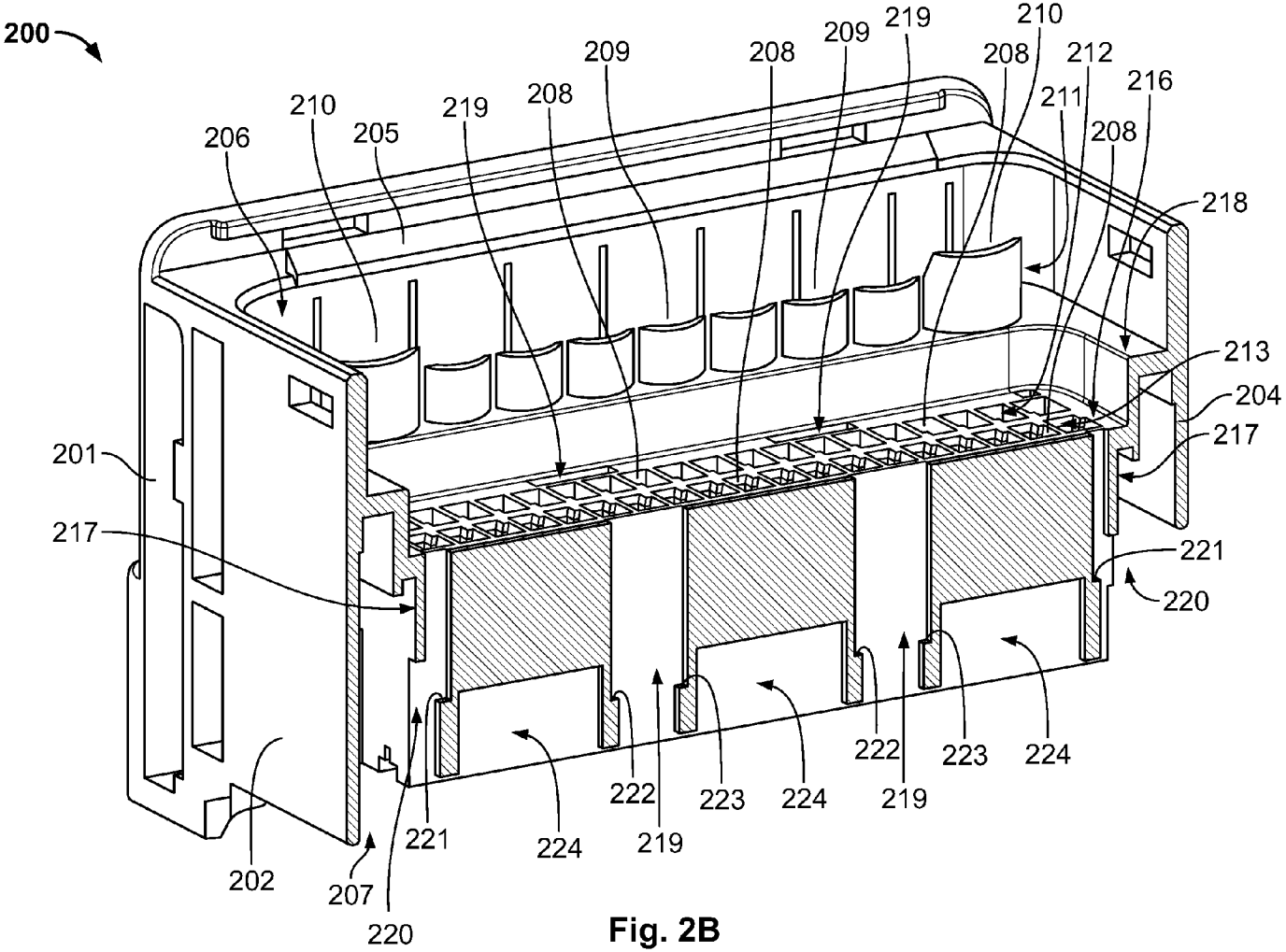
FIG. 2B is a section view of the main housing shown in FIG. 2A.

FIG. 2A schematically shows an embodiment example of a main housing 200 of an electrical connector, according to one aspect of the present invention, in a three-dimensional view, and FIG. 2B shows the main housing 200 shown in FIG. 2A in a section view.

As shown in FIGS. 2A-2B, a main housing 200 of an electrical connector according to this aspect of the present invention can comprise a body 201 of substantially parallelepiped shape, with four walls 202, 203, 204, 205 and two main open faces 206, 207, inside which is arranged a plurality of guide sockets 208, 209, 210 that are designed to guide electrical conductors, such as electric cables, provided with electric contact terminals to be inserted into corresponding contact sockets of a front housing of said electrical connector. One of the main faces of the main housing 200, in this case the main face 206, therefore can be configured to at least partially receive a rear housing of said electrical connector, whereas the opposite main face, in this case therefore the main face 207, can be configured to at least partially receive a front housing of an electrical connector, for example the front housing 100 of the embodiment shown in FIGS. 1A-1B.

According to one variant of an embodiment of an aspect of the present invention, the guide sockets 208, 209, 210 can be adapted to one or more types of electrical conductors and therefore can have different diameters, in particular. In the example shown in FIGS. 2A-2B, and more particularly as can be seen in the section of FIG. 2B, three types of guide sockets 208, 209, 210 are shown. For the sake of clarity, as is the case for the embodiment of the front housing 100 shown in FIGS. 1A-1B, only certain guide sockets 208, 209, 210 have been given reference numerals. Similarly, according to a further advantageous variant, the plurality of guide sockets 208, 209, 210 is arranged in rows of guide sockets 211, 212, 213, 214, 215.

Furthermore, according to a further variant of one aspect of the present invention, which is advantageous for sealed applications, certain guide sockets 208, 209, 210, in this case the guide sockets 209, 210, can be seal channels 209, 210 configured to guide electrical conductors provided with a single-wire seal. According to a further variant, it is possible for the seal channels to have different diameters. Therefore, the diameters of the seal channels 210 shown in the section view of FIG. 2B are greater than the diameters of the seal channels 209, which in turn can respectively receive an electrical conductor with a diameter that is greater than that of the conductors received in each of the plurality of guide sockets 208.

According to one advantageous variant of this aspect of the present invention, when the electrical connector comprising the main housing 200 is designed for sealed applications, the main housing 200 can comprise a plurality of zones designed to receive seals. In this way, as can be seen in the section shown in FIG. 2B, the main housing 200 can comprise a rear seal reception zone 216 and/or a peripheral seal reception zone 217. The rear seal reception zone 216 therefore can be used to receive a rear seal designed to isolate the plurality of contact sockets 208 within the context of a sealed application. As can also be seen in FIG. 2B, the main housing 200 can comprise a rear housing reception zone 218 on the side of the main face 206.

According to one aspect of the present invention, as can be seen in the section view shown in FIG. 2B, the main housing 200 can comprise at least one locking zone 219, 220 arranged between the guide sockets 208, 209, 210 and in particular as many locking zones 219, 220 as there are locking means comprised in the front housing to be mounted in the main housing 200. Therefore, in the case in which the main housing 200 shown in FIG. 2B is assembled with the front housing 100 shown in FIGS. 1A-1B, locking zones 219 are configured to receive the hooks 121 of the front housing 100, and locking zones 220 are configured to receive the harpoons 120 of the front housing 100. According to a variant of an embodiment, the locking zones 219, 220 form troughs 219, 220 passing right through the body 201 of the main housing 200, but only partially separating the respective rows 211 and 212, as well as 213 and 214, over their length.

According to one variant of an embodiment, each of the locking zones 219, 220 respectively comprises at least one stop for locking a locking means of a front housing. In the case that the main housing 200 is configured to receive the front housing 100, this is advantageous as the locking zones 219 can each comprise a stop 221 for locking the locking catch 125 of a hook 121, whereas the locking zones 220 can each comprise two stops 222, 223 for blocking the locking catches 128, 129 of a harpoon 120 once the front housing 100 is assembled with the main housing 200, as shown in particular in FIG. 3. Therefore, when the electrical connector comprising the front housing 100 and the main housing 200 is assembled, the retention force between the front housing 100 and the main housing 200 is sufficient to keep the front housing 100 rigidly connected to the main housing 200 during operations for connecting or disconnecting the connector to/from a counterpart base.

Furthermore, according to one variant of an embodiment of this aspect, the main housing 200 can comprise, at the main face 207 receiving the front housing 100, a plurality of troughs 224 that are reception zones 224 configured to receive walls for protecting electric contacts of a base. Some troughs 224 are not shown in FIG. 2B, however a person skilled in the art will understand that in this variant of an embodiment of a main housing according to this aspect of the invention, three protection wall reception zones 224, not shown in FIG. 2B, are arranged between the rows 211 and 212, and three zones 224, shown in FIG. 2B, are arranged between the rows 213 and 214, alternating with locking zones 219, 220.

A person skilled in the art will understand that the modulability criteria that have been previously mentioned with reference to the front housing 100 shown in FIGS. 1A-1B can also be applied to the main housing 200, particularly with regard to the arrangement, the type and the quantity of the guide sockets 208, 209, 210, or even the quantity and the dimensions of the locking zones 219, 220, as a function of the number and of the type of electrical connections to be effected.

Figure 3:
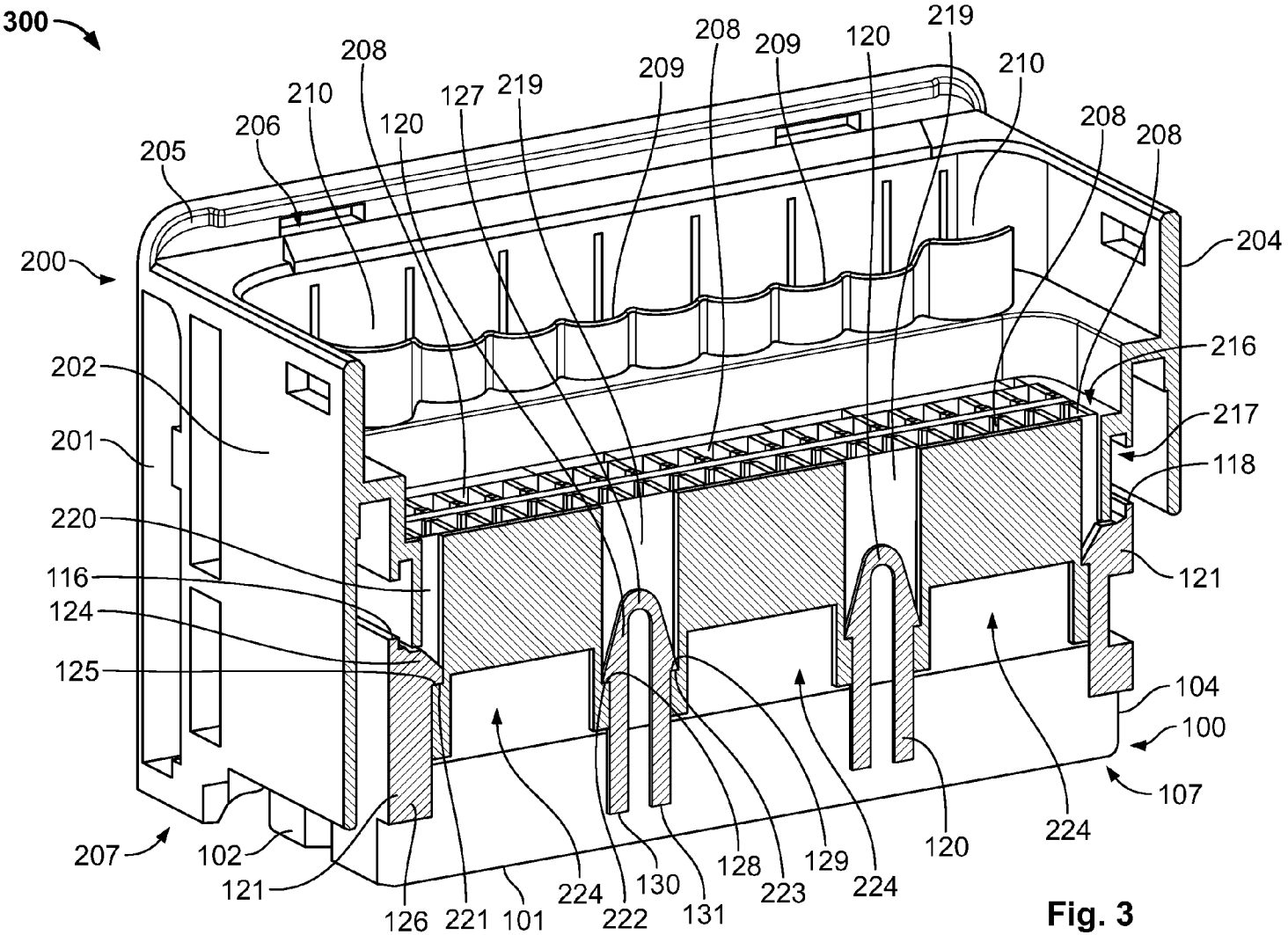
FIG. 3 is a section view schematically showing the front housing of the embodiment shown in FIGS. 1A-1B mounted in the main housing of the embodiment shown in FIGS. 2A-2B.

FIG. 3 is a section view schematically showing part of an electrical connector 300 comprising the assembly of the front housing 100 of the embodiment shown in FIGS. 1A-1B mounted in the main housing 200 of the embodiment shown in FIGS. 2A-2B. For the sake of clarity, no seal and/or electrical conductor and/or rear housing and/or cover has been shown in FIG. 3.

Therefore, in the embodiment example of an electrical connector 300 shown in FIG. 3, the plurality of contact sockets 108, 109, 110 of the front housing 100 and the plurality of guide sockets 208, 209, 210 is arranged in a complementary manner. The rows of guide sockets 211, 212, 213, 214, 215 therefore respectively correspond to the rows of contact sockets 111, 112, 113, 114, 115, respectively. In other words, the plurality of guide sockets 208 corresponds to the plurality of contact sockets 108, the plurality of seal channels 209 corresponds to the contact sockets 109 and the seal channels 210 correspond to the contact sockets 110.

As shown in FIG. 3, once the main housing 200 is assembled with the front housing 100, each of the hooks 121 is engaged in a corresponding locking zone 220. In this embodiment, the four hooks 121, as shown in FIGS. 1A-1B, are engaged in corresponding locking zones 220. Similarly, the four harpoons 120 are engaged in the respective locking zones 219 of the main housing 200. During assembly, the heads 124 of the hooks 121 and the heads 127 of the harpoons 120, as well as the exposed parts of the respective stems 126 and 130, 131, therefore have been deflected so as to engage the locking zones 219, 220 of the main housing 200.

Therefore, once the assembly is complete, and as shown in FIG. 3, the locking catches 125 and 128, 129 of the locking means 121 and 120, respectively, come into abutment against the respective surfaces 221 and 222, 223 of the corresponding locking zones 219, 220 in the main housing 200, so that the retention of the front housing 100 with the main housing 200 is guaranteed. In particular, when the electrical connector 300 comprising the front housing 100 and the main housing 200 is assembled, the retention force between the front housing 100 and the main housing 200 is sufficient to keep the front housing 100 rigidly connected to the main housing 200 during the operations for connecting or disconnecting the connector 300 to/from a counterpart base.

Figure 4:
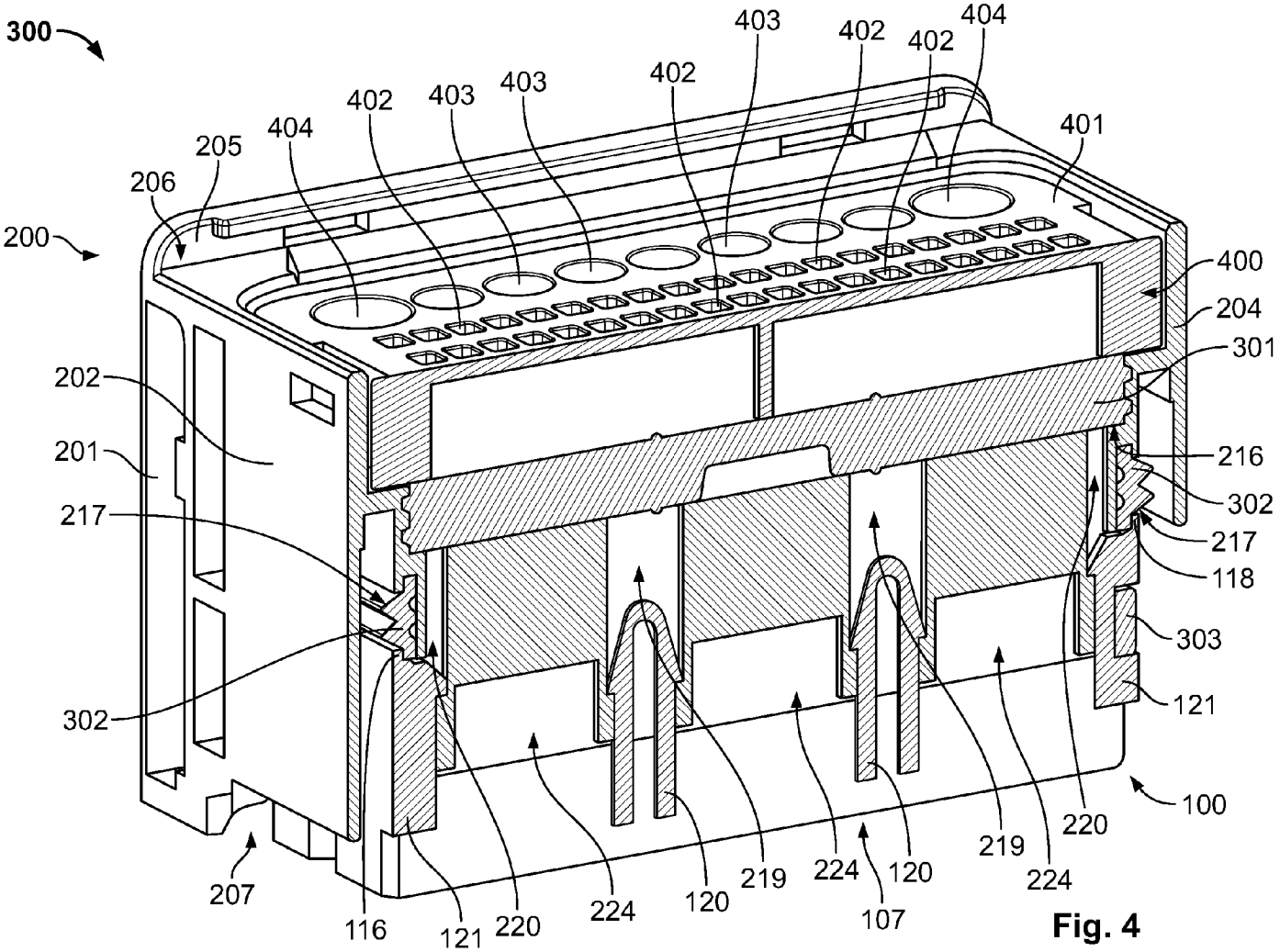
FIG. 4 is a section view schematically showing the assembly of FIG. 3, further comprising seals and a rear housing.

FIG. 4 is a section view schematically showing the electrical connector 300 comprising the assembly of the front housing 100 with the main housing 200 as shown in FIG. 3, further comprising seals, in particular a rear seal or "grommet" 301, and a peripheral seal 302, a rear housing 400, as well as a secondary locking device 303.

As shown in FIG. 4, the main housing 200 can receive a rear housing 400 on its main face 206 opposite the main face 207 assembled on the front housing 100. A rear housing 400 can comprise a main body 401, in which a plurality of guide sockets 402, 403, 404 is arranged, which sockets are designed to guide electrical conductors toward the corresponding sockets 208, 209, 210 of the main housing 200. Therefore, in the embodiment example shown in FIG. 4, the front housing comprises a plurality of guide sockets 402 corresponding to the guide sockets 208, a plurality of guide sockets 403 corresponding to the seal channels 209, as well as two guide sockets 404, arranged either side of the row of sockets of the type referenced 403, corresponding to the seal channels 210 of the main housing 200. The sockets 402, 403, 404 therefore advantageously can be arranged basically the same as the sockets 208, 209, 210 of the main housing 200 and as the contact sockets 108, 109, 110 of the front housing 100.

The rear seal 301 can then provide the seal between the main housing 200 and the rear housing 400. To this end, as shown in FIG. 4, it therefore can be arranged in the rear seal reception zone 216 of the main housing 200 so as to isolate the block comprising the guide sockets 208 and can then particularly provide the seal for the contact sockets 108 of the front housing 100 when the connector 300 is used for sealed applications.

As can also be seen in FIG. 4, the peripheral seal 302 in turn can be arranged in the peripheral seal reception zone 217 of the main housing 200 so that it comes into abutment with the peripheral ribs 116, 117, 118, 119 of the walls 102, 103, 104, 105 of the front housing 100, further isolating the contact sockets 108, 109, 110 of the front housing 100, which is advantageous for the sealed applications.

In an electrical connector 300 for applications in the automotive field, the use of a secondary locking device 303, as shown concisely in FIG. 4, is preferable in order to ensure the terminals of electrical conductors are properly locked in the contact sockets 108, 109, 110 of the front housing 100. Such devices 303 are known in the prior art and do not form part of the present invention.

Figure 5:
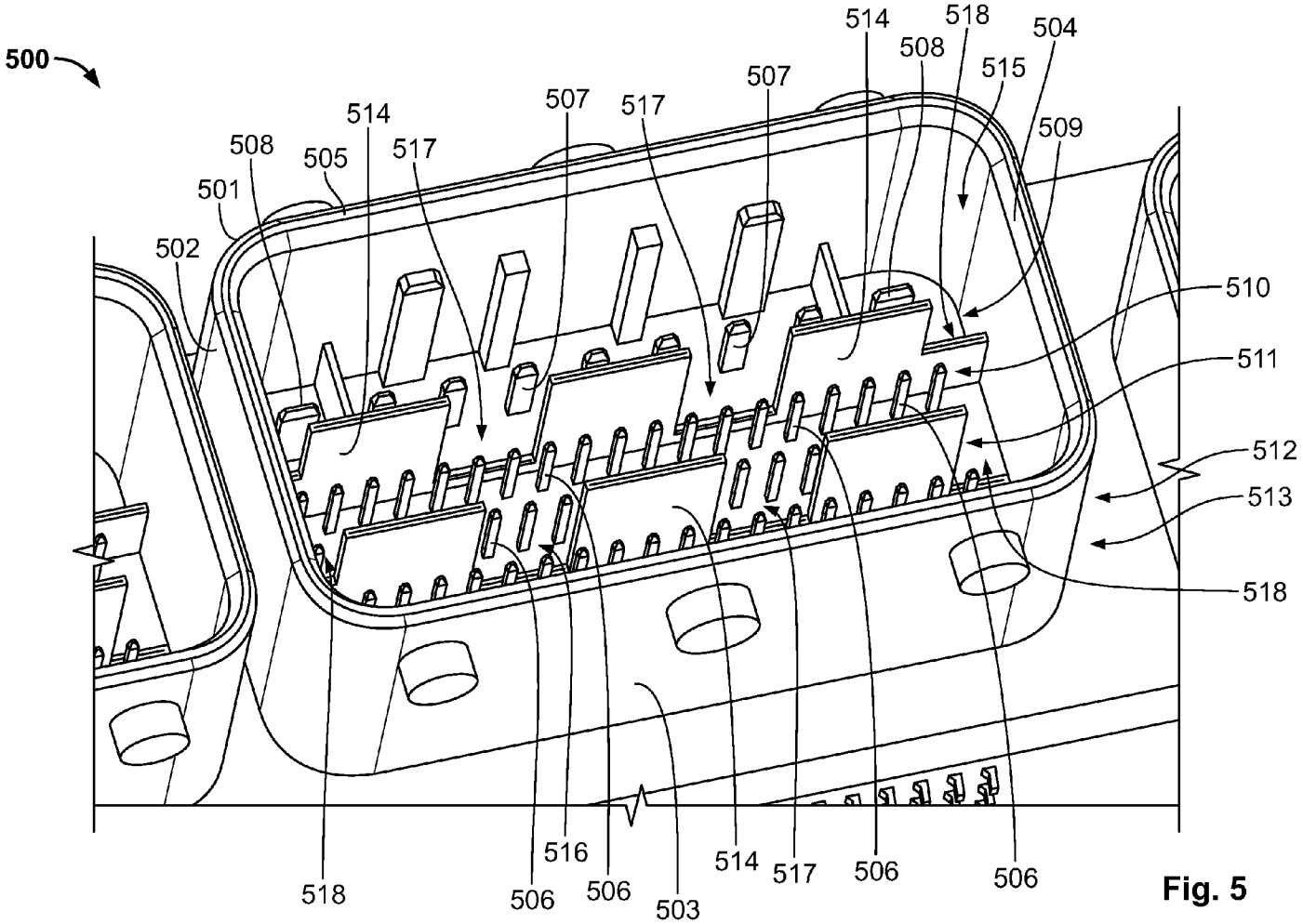
FIG. 5 schematically shows an embodiment example of a base for an electrical connector according to a further aspect of the present invention.

FIG. 5 schematically shows an embodiment example of a base 500 for an electrical connector 300 according to a further aspect of the present invention. Such a base 500 can be used jointly with a front housing 100 such as that of the embodiment shown in FIGS. 1A-1B and/or with a main housing 200 such as that of the embodiment shown in FIGS. 2A-2B and/or with an electrical connector 300 such as that shown in FIGS. 3 and 4.

According to variants of embodiments of one aspect of the present invention, the base 500 shown in FIG. 5 can comprise a substantially parallelepiped body 501 with four walls 502, 503, 504, 505 that are open on a face 515 and are closed on a bottom 516 opposite the open face 515. The base 500 can comprise a plurality of electric contact pins 506, 507, 508 arranged so as to project from the bottom 516 of the base 500. Therefore, at its open face 515, the base 500 can receive the front housing 100 and/or the main housing 200 and/or in general the connector 300 in order to electrically connect a plurality of electrical conductors of the connector 300 to the contact pins 506, 507, 508.

In this embodiment, the base 500 can be used with the front housing 100 and/or the main housing 200 and/or the connector 300 of the preceding embodiments. The contact pins 506, 507, 508 are therefore arranged in parallel rows 509, 510, 511, 512, 513 so that the plurality of contact pins 506, 507, 508 are counterparts for the terminals of the conductors accommodated in the contact sockets 108, 109, 110 of the front housing 100, respectively. However, a person skilled in the art will understand that the geometry of the contact pins 506, 507, 508, as well as their quantity and arrangement within the base 500, can depend on the requirements of the user and therefore can vary relative to the appended drawings, and the same is the case for the dimensions, quantities and the arrangement of the contact sockets 108, 109, 110 and the guide sockets 208, 209, 210, as well as the corresponding sockets of the rear housing 400.

According to one aspect of the present invention, the base 500 further comprises at least one wall 514 to protect the contact pins 506, 507, 508 and which is configured to be received in a corresponding trough 122, 123 of the front housing 100 and/or in a protection wall reception zone 224 of the main housing 200. Such a protection wall 514 advantageously prevents the fingers of a user handling the base 500 from accidentally bending the electric contact pins 506, 507, 508. According to one aspect of the present invention, this at least one protection wall 514 is discontinuous over the length of the base 500, i.e. the rows of contact pins 509, 510, 511, 512, 513, in order to allow the at least one locking means 120, 121 of the front housing 100 to be accommodated, as is shown more clearly in the assembly 700 of FIG. 6.

Figure 6:
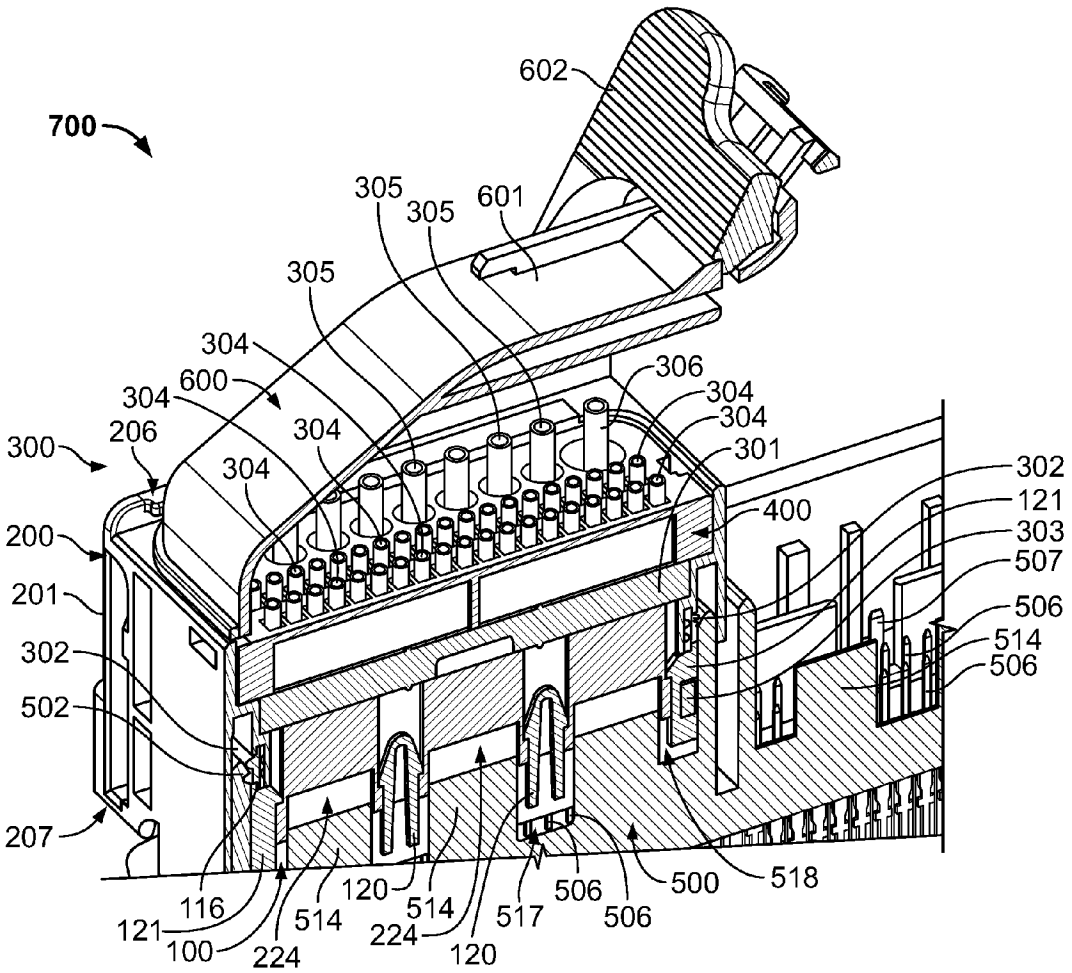
FIG. 6 schematically shows an embodiment example of an electrical connector comprising the assembly shown in FIG. 4 connected to the base shown in FIG. 5.

In the embodiment example shown in FIG. 5, the base 500 therefore comprises six walls 514 arranged so as to engage the troughs 122, 123 of the front housing 100 whilst leaving spaces or slots 517, 518 that are necessary for the respective passage of the harpoons 120 and hooks 121, as shown in FIG. 6. As can also be seen in FIG. 6, the protection walls 514 are also configured to engage the reception zones 224 of the main housing 200.

FIG. 6 schematically shows an embodiment example of an assembly 700 of an electrical connector 300 comprising the assembly shown in FIG. 4 connected to the base 500 shown in FIG. 5.

In addition to the aforementioned features, the electrical connector 300 of the assembly 700 now comprises a cover 600, the main part 601 of which is accommodated in the main face 206 of the main housing 200, thus covering the rear housing 400, which in turn allows a plurality of electrical conductors 304, 305, 306 to be guided from the inside of the main part 601 of the cover 600 toward the corresponding guide sockets 208, 209, 210 of the main housing 200. The cover 600 of the connector 300 can also comprise a locking lever 602, shown in the closed position in FIG. 6, designed to engage the locking of the connector 300 to the base 500. When the electrical connector 300 is connected to the base 500 and the locking lever 602 locks the assembly 700, the walls 502, 503, 504, 505 of the base 500 and the walls 102, 103, 104, 105 of the front housing 100, particularly the ribs 116, 117, 118, 119, come into abutment against the peripheral seal 302, thus providing the seal for the electric contacts between the pins 506, 507, 508 and the conductors 304, 305, 306 accommodated in the contact sockets 108, 109, 110 relative to the outside of the connector 300, in addition to the description provided with reference to FIG. 4.

In one advantageous variant of an embodiment of the present invention, shown in FIG. 6, it is possible to connect various types of conductors 304, 305, 306 to the base 500, particularly conductors 304, 305, 306 with different diameters, particularly diameters for which the contact sockets 108, 109, 110 and the previously described guide sockets 208, 209, 210 are designed. Therefore, the conductors 304 are connected through the rear housing 400, then the guide sockets 208 of the main housing 200, to the contact sockets 108 of the front housing 100 and are thus electrically connected to the pins 506 of the base 500. Similarly, the conductors 305, 306 can be cables with single-wire seals with different diameters connected through the rear housing 400, then the seal channels 209, 210 of the main housing 200, to the corresponding contact sockets 109, 110 of the front housing 100 and therefore can be electrically connected to the pins 507, 508 of the base 500 in the assembly 700 shown in FIG. 6.

FIGS. 5 and 6 also show that a plurality of bases 500 can be arranged in series on the same support. Thus, it is possible, in a restricted zone of a motor vehicle, to arrange a plurality of bases 500 in series, but also alternatively as a matrix, and to connect them to a plurality of connectors 300 to form a plurality of assemblies 700 having the previously described advantages of the various aspects of the present invention.

Therefore, it will be apparent to a person skilled in the art that combining the previously described various aspects of the present invention is advantageous.

Furthermore, various aspects of the invention allow the use of various types of locking means 120, 121 and the quantity and the size to be adapted according to the retention force required between the front housing 100 and the main housing 200. Thus, the more conductors 304, 305, 306 that the connector 300 comprises, which conductors are to be connected to the corresponding contacts 506, 507, 508 of the base 500, the greater the necessity for retaining the front housing 100 with the main housing 200 during an operation for disconnecting the connector 300 and the base 500. Advantageously, therefore, the invention allows the number and the size of the hooks 121 and harpoons 120 of the front housing 100 to be adapted, as well as the corresponding locking zones 219, 220 of the main housing 200, in order to enhance the retention between these two elements 100, 200 of the connector 300, which is an advantage compared to the known connectors of the prior art. Therefore, the invention allows disconnection to be prevented between the front housing 100 and the main housing 200 compared to the known housings of the prior art, whilst keeping the support surface of the peripheral seal 302 arranged on the main housing 200, which is also an advantage compared to the connector systems for sealed applications that are known in the prior art.

The arrangement of the locking means 120, 121, as previously described, is advantageous compared to the known front housings of the prior art as it allows the simplified integration of the inventive retention means 120, 121 in the moulds used in plastics technology, without increasing the design complexity, particularly for an electrical connector 300 with a large number of conductors 304, 305, 306. In particular, the previously described hooks 121 and harpoons 120 have the advantage, compared to the known retention systems of the prior art, of being able to be wholly obtained basically using the two main moulding directions of plastics technology, without using an additional mould slide and without crossing between mould slides or additional movement in the mould during moulding.

In alternative embodiments of the aspects of the present invention, it is possible to reverse the arrangement of the elements of the locking system between the main housing and the front housing. In this way, it is possible to arrange hooks 121 and harpoons 120 on the main housing 200 instead of on the front housing 100 and to arrange corresponding locking zones 219, 220 on the front housing 100 instead of on the main housing 200, as long as the locking means and locking zones are always arranged between the contact sockets 108, 109, 110 and the guide sockets 208, 209, 210 in order to provide the proper support surface for the peripheral seal 302.

In the embodiment example of the main housing 200 as previously described, the arrangement of the locking zones 219, 220 allows, particularly in combination with the locking means 120, 121 of the front housing 100, a good support surface to be provided for the peripheral seal 302 arranged on the main housing 200. Furthermore, the locking zones 219, 220 can also be simply implemented in plastics technology without further complicating the design of the mould for the main housing 200.

By virtue of its various aspects, the present invention therefore is advantageous when a high retention force is required between two parts 100, 200 of an electrical connector 300, such as the front housing 100 and the main housing 200 described above. In particular, the invention is advantageous when disconnecting the assembled connector 300 and the base 500, as it prevents the front housing 100 of the electrical connector 300 from remaining locked in the base 500 whilst the rest of the connector 300, in particular the main housing 200, is disconnected therefrom. When disconnecting the connector 300 and the base 500, the front housing 100 and the main housing 200 therefore remain rigidly connected to each other, whereas the front housing 100, and more generally the connector 300, is disconnected from the base 500, which is an advantage compared to the known systems of the prior art in which the retention force between the main housing and the front housing is not sufficient to prevent them from being disconnected during disconnection from a base.

Therefore, the invention is advantageous for electrical connectors arranged in restricted spaces and/or for connectors comprising a large number of channels, i.e. a large number of electrical conductors to be connected to counterpart contacts of a base. The invention is particularly adapted to the field of motor vehicle connectors, particularly for applications in sealed environments in which the main housing comprises a rear seal and/or a peripheral seal.

REFERENCE NUMERALS

| | |
|---|---|
| 100 | front housing |
| 101 | front housing body |
| 102 | wall |
| 103 | wall |
| 104 | wall |
| 105 | wall |
| 106 | main face |
| 107 | main face |
| 108 | contact socket |
| 109 | contact socket |
| 110 | contact socket |
| 111 | row of sockets |
| 112 | row of sockets |
| 113 | row of sockets |
| 114 | row of sockets |
| 115 | row of sockets |
| 116 | rib |
| 117 | rib |
| 118 | rib |
| 119 | rib |
| 120 | locking means |
| 121 | locking means |
| 122 | trough |
| 123 | trough |
| 124 | head |
| 125 | locking catch |
| 126 | stem |
| 127 | head |
| 128 | locking catch |
| 129 | locking catch |
| 130 | stem |
| 131 | stem |
| 200 | main housing |
| 201 | body of the main housing |
| 202 | wall |
| 203 | wall |
| 204 | wall |
| 205 | wall |
| 206 | main face |
| 207 | main face |
| 208 | guide socket |
| 209 | seal channel |
| 210 | seal channel |
| 211 | row of sockets |
| 212 | row of sockets |
| 213 | row of sockets |
| 214 | row of sockets |
| 215 | row of sockets |
| 216 | rear seal reception zone |
| 217 | peripheral seal reception zone |
| 218 | rear housing reception zone |
| 219 | locking zone |
| 220 | locking zone |
| 221 | stop |
| 222 | stop |
| 223 | stop |
| 224 | wall reception zones |
| 300 | assembly |
| 301 | rear seal or "grommet" |
| 302 | peripheral seal |
| 303 | secondary lock |
| 304 | electrical conductor |
| 305 | conductor with single-wire seal |
| 306 | conductor with single-wire seal |

-continued

| REFERENCE NUMERALS |
|---|
| 400 rear housing |
| 401 body of the rear housing |
| 402 guide socket |
| 403 guide socket |
| 404 guide socket |
| 500 base |
| 501 body of the base |
| 502 wall |
| 503 wall |
| 504 wall |
| 505 wall |
| 506 electric contact pin |
| 507 electric contact pin |
| 508 electric contact pin |
| 509 row of contacts |
| 510 row of contacts |
| 511 row of contacts |
| 512 row of contacts |
| 513 row of contacts |
| 514 protection walls |
| 515 open face |
| 516 bottom of base |
| 517 slot |
| 518 slot |
| 600 cover |
| 601 main part of cover |
| 602 locking lever |
| 700 assembly |

The invention claimed is:

1. A front housing of an electrical connector, said front housing being designed to be connected to a base and being configured to be at least partially received in a main housing of said electrical connector, said front housing comprising:

at least one locking member configured to engage a corresponding locking zone of the main housing so as to lock said front housing to the main housing;

said front housing further comprising a plurality of contact sockets designed to each receive an electrical conductor to be connected to said base, and said contact sockets of said plurality of contact sockets are arranged in rows of contact sockets, the rows of contact sockets comprising at least a first row extending adjacent a peripheral outer edge of the front housing and a second row extending parallel to and inward of the first row; and said at least one locking member is arranged between the first and second rows of contact sockets of said plurality of contact sockets and in at least one trough separating said rows of contact sockets.

2. The front housing of an electrical connector according to claim 1, wherein said locking member project relative to a zone of said front housing comprising said plurality of contact sockets.

3. The front housing of an electrical connector according to claim 1, wherein at least one locking member is a hook comprising a head provided with a locking catch, and further comprising a stem extending from said head.

4. The front housing of an electrical connector according to claim 3, wherein said at least one locking member is arranged in at least one trough separating rows of contact sockets and wherein said stems extend inside of said at least one trough.

5. The front housing of an electrical connector according to claim 1, wherein at least one locking member is a harpoon comprising a head provided with two locking catches, and further comprising two stems extending from said head substantially in an inverted U-shape.

6. An electrical connector, comprising:

a main housing and a front housing;

the main housing being configured to at least partially receive the front housing and comprising at least one locking zone;

the front housing having at least one locking member configured to engage the corresponding locking zone of the main housing so as to lock said front housing to the main housing;

the front housing and main housing cooperatively defining a plurality of contact sockets designed to each receive an electrical conductor coupled to the electrical connector and positioned within the front housing and the main housing, and the front housing being profiled to be connected to a base;

a plurality of conductor guide sockets each corresponding to a respective contact socket of said front housing, said at least one locking zone is arranged between guide sockets of said plurality of guide sockets, the sockets of said plurality of guide sockets are arranged in rows of guide sockets corresponding to the rows of contact sockets of the front housing, said contact sockets of said plurality of contact sockets are arranged in rows of contact sockets, said at least one locking member is arranged between rows of contact sockets, and said at least one locking zone is arranged between rows of guide sockets; and the at least one locking member is arranged between rows of contact sockets of said plurality of contact sockets and substantially forms a trough partially separating rows of guide sockets.

7. The electrical connector according to claim 6, wherein said at least one locking zone comprises at least one stop for effecting a lock with a corresponding locking catch of the at least one locking member of a front housing, where the at least one locking member is a harpoon comprising a head provided with two locking catches, and further comprising two stems extending from said head substantially in an inverted U-shape.

8. An electrical connector assembly, designed to connect a plurality of electrical conductors to a base, said electrical connector comprising:

a front housing and a main housing;

the front housing having at least one locking member configured to engage a corresponding locking zone of the main housing so as to lock said front housing to the main housing, said front housing further comprising a plurality of contact sockets designed to each receive an electrical conductor to be connected to said base, and said at least one locking member is arranged between contact sockets of said plurality of contact sockets, wherein said at least one locking member is arranged in the front housing in at least one trough separating rows of contact sockets;

the main housing having at least one locking zone configured to receive a corresponding locking member of the front housing, and being configured to partially receive a rear housing from a first side and said front housing from a second side, opposite the first side; and a base designed to be connected to the electrical connector comprising a plurality of electric contacts, arranged in rows of electric contacts, and at least one protection wall arranged between rows of electric contacts, and configured to be received in the at least one trough of said front housing.

9. The electrical connector assembly according to claim 8, further comprising:

a cover, configured to guide a plurality of electrical conductors in said electrical connector and to lock said electrical connector to a base, and/or a rear housing, configured to guide said plurality of electrical conductors from said cover toward said main housing, and/or at least one rear seal arranged on a periphery of said main housing.

10. The electrical connector assembly according to claim 8, wherein said at least one protection wall is discontinuous over its length, particularly over a length of said rows of electric contacts, such that at least one slot is adapted to partially receive the corresponding locking member of said front housing of said electrical connector.

11. An electrical connector assembly, comprising:

an electrical connector comprising a front housing and a main housing;

the front housing having at least one locking member configured to engage a corresponding locking zone of the main housing so as to lock said front housing to the main housing, said front housing further comprising a plurality of contact sockets designed to each receive an electrical conductor to be connected to said base, and said at least one locking member is arranged in at least one trough separating rows of contact sockets of said plurality of contact sockets; and the main housing having at least one locking zone configured to receive a corresponding locking member of the front housing, and being configured to partially receive a rear housing from a first side and said front housing from a second side, opposite the first side;

a base comprising a plurality of electric contacts, particularly arranged in rows of electric contacts, and at least one protection wall arranged between said electric contacts, particularly arranged between rows of electric contacts, configured to be received in a corresponding trough of said front housing, and, wherein said at least one protection wall is discontinuous over its length, particularly over a length of said rows of electric contacts, such that at least one slot is adapted to partially receive a corresponding locking member of said front housing of said electrical connector; and a plurality of electrical conductors designed to be connected to the electric contacts of the base.

* * * * *